US007246507B2

(12) United States Patent
Yamada et al.

(10) Patent No.: US 7,246,507 B2
(45) Date of Patent: Jul. 24, 2007

(54) AIR CONDITIONER

(75) Inventors: Yoshihito Yamada, Kusatsu (JP); Hideyuki Kanzaki, Moriyama (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 191 days.

(21) Appl. No.: 11/169,347

(22) Filed: Jun. 29, 2005

(65) Prior Publication Data

US 2006/0005570 A1 Jan. 12, 2006

(30) Foreign Application Priority Data

Jul. 8, 2004 (JP) ..... 2004-201521

(51) Int. Cl.
*F25B 43/02* (2006.01)

(52) U.S. Cl. ..... 62/470; 63/473

(58) Field of Classification Search ..... 62/192, 62/193, 470, 473, 510
See application file for complete search history.

(56) References Cited

U.S. PATENT DOCUMENTS 3,138,007 A * 6/1964 Friedman et al. ..... 62/278
3,633,377 A * 1/1972 Quick ..... 62/192
4,589,263 A * 5/1986 DiCarlo et al. ..... 62/193
5,361,595 A * 11/1994 Shimura et al. ..... 62/175
5,509,273 A * 4/1996 Lakowske et al. ..... 62/228.5
5,542,499 A * 8/1996 Westermeyer ..... 184/103.2
5,553,460 A * 9/1996 Isaacs ..... 62/129
5,605,058 A * 2/1997 Kurachi et al. ..... 62/503
5,634,345 A * 6/1997 Alsenz ..... 62/84
5,673,567 A * 10/1997 Dube ..... 62/117
5,692,389 A * 12/1997 Lord et al. ..... 62/222
5,694,784 A * 12/1997 Frey et al. ..... 62/228.5
5,768,903 A * 6/1998 Sekigami et al. ..... 62/196.2

FOREIGN PATENT DOCUMENTS

JP 11-117884 4/1999
JP 2001-82815 A * 3/2001

* cited by examiner

*Primary Examiner*—Mohammad M. Ali
(74) *Attorney, Agent, or Firm*—RatnerPrestia

(57) ABSTRACT

Provided is an air conditioner which has a separator with an oil tank for storing extra oil; a first oil return tube opening above the surface of the extra oil; and a second oil return tube opening below the surface of the extra oil. When the refrigeration cycle cannot maintain the required oil dilution ratio as a result of the refrigerant having been replenished to cope with long piping, extra oil can be supplied from the second oil return tube to maintain the required oil dilution ratio in the refrigeration cycle, while using a highly versatile general compressor.

1 Claim, 5 Drawing Sheets

AIR CONDITIONER

BACKGROUND OF THE INVENTION

1. Field of the Invention

The present invention relates to an air conditioner having a plurality of indoor units and one or more outdoor units which are connected in parallel with each other.

2. Background Art

In recent years, with improved living standards and their workability, air conditioners have come to require less and less space for their installation and also to be expected to be able to air condition a whole building. With this tendency, the demands for smaller compressors and for multi-room type air conditioners provided with a plurality of indoor units are on the increase. To meet this demand, it has been tried to stabilize the lubricating oil used in the compressors.

An air conditioner provided with a plurality of indoor units and a plurality of outdoor units connected in parallel is known from Japanese Patent Unexamined Publication No. H11-117884. A system of this type requires long piping, so that refrigerant is replenished to provide the necessary amount. However, the replenishment of the refrigerant causes the oil amount in the refrigeration cycle to be insufficient, thus lowering the ratio of the oil to the refrigerant (hereinafter, the oil dilution ratio). This damages the reliability of the compressor.

FIG. 5 is a system diagram showing a conventional air conditioner. In the refrigeration cycle, refrigerant circulates through compressor 1, condenser 2, throttle mechanism 3, an evaporator of indoor unit A and accumulator 6 in this order and returns to compressor 1. Between compressor 1 and condenser 2 is provided oil separator 7. Oil separator 7 is a device to return lubricating oil discharged to the exhaust gas from compressor 1 to compressor 1 in order to prevent a supply shortage of the lubricating oil in compressor 1, which may cause burning, and also to prevent the mixing of the oil into the circulating refrigerant, which will deteriorate the refrigerating capacity. Oil separator 7, which is a sealed container, puts the exhaust gas in the container through its inlet connected to the discharge side of compressor 1, and drops oil contained in the exhaust gas and accumulates it in the container. Oil separator 7 also discharges refrigerant gas, that is, oil-free exhaust gas through its outlet connected to the suction side of condenser 2. The oil accumulated in the container is to be returned to compressor 1 via accumulator 6 though a suction tube connected to an oil return tube in response to the detection of a predetermined liquid level from a float provided in the container.

In such an air conditioner, the use of conventional oil separator 7 allows the oil separated from the refrigerant to be returned to the compressor. However, when the type of indoor unit A is changed, a larger number of indoor units A are connected, or a plurality of outdoor units B are connected by the users request, the piping becomes longer, making it necessary to replenish the refrigerant to supply the sufficient amount. This causes the oil amount in the refrigeration cycle insufficient, making it impossible to maintain the required oil dilution ratio.

SUMMARY OF THE INVENTION

In order to solve the aforementioned problem, the present invention is provided with an oil separator which has a predetermined capacity and can store extra oil (hereinafter, separator with the oil tank) on the high-pressure side. As a result, in an air conditioner provided with a plurality of compressors, the oil level can be maintained in each of the compressors, thereby improving the reliability. In addition, the oil separator with the oil tank having the predetermined capacity can act as a buffer in response to an increase or decrease in the oil amount in the piping. In the case of a refrigeration cycle with a plurality of outdoor units connected in parallel, the separator with the oil tank distributes oil in such a manner as not to supply the outdoor units with too little or too much oil. The way of the distribution is not affected by the properties of the refrigerant or oil to be used. This makes it possible to provide a separator with the oil tank which can securely return oil to highly versatile general compressors, while maintaining the required oil dilution ratio in the refrigeration cycle.

In the air conditioner of the present invention, a separator with an oil tank which includes a reservoir to store extra oil, a first oil return tube having an opening above the surface of the extra oil, and a second oil return tube having an opening below the surface of the extra oil is provided in a high-pressure gas circuit in which refrigerant is always in gas phase. With this structure, the lubricating oil discharged into the exhaust gas from the compressors, which are basic functional components, can be separated, stored and returned to the compressors. The structure also makes it possible to maintain the required oil dilution ratio in refrigeration cycle, while using highly versatile general compressors.

DETAILED DESCRIPTION OF THE INVENTION

Embodiments of the present invention will be described as follows with reference to accompanying drawings. Note that the present invention is not limited to these embodiments described below.

FIRST EMBODIMENT

Figure 1:
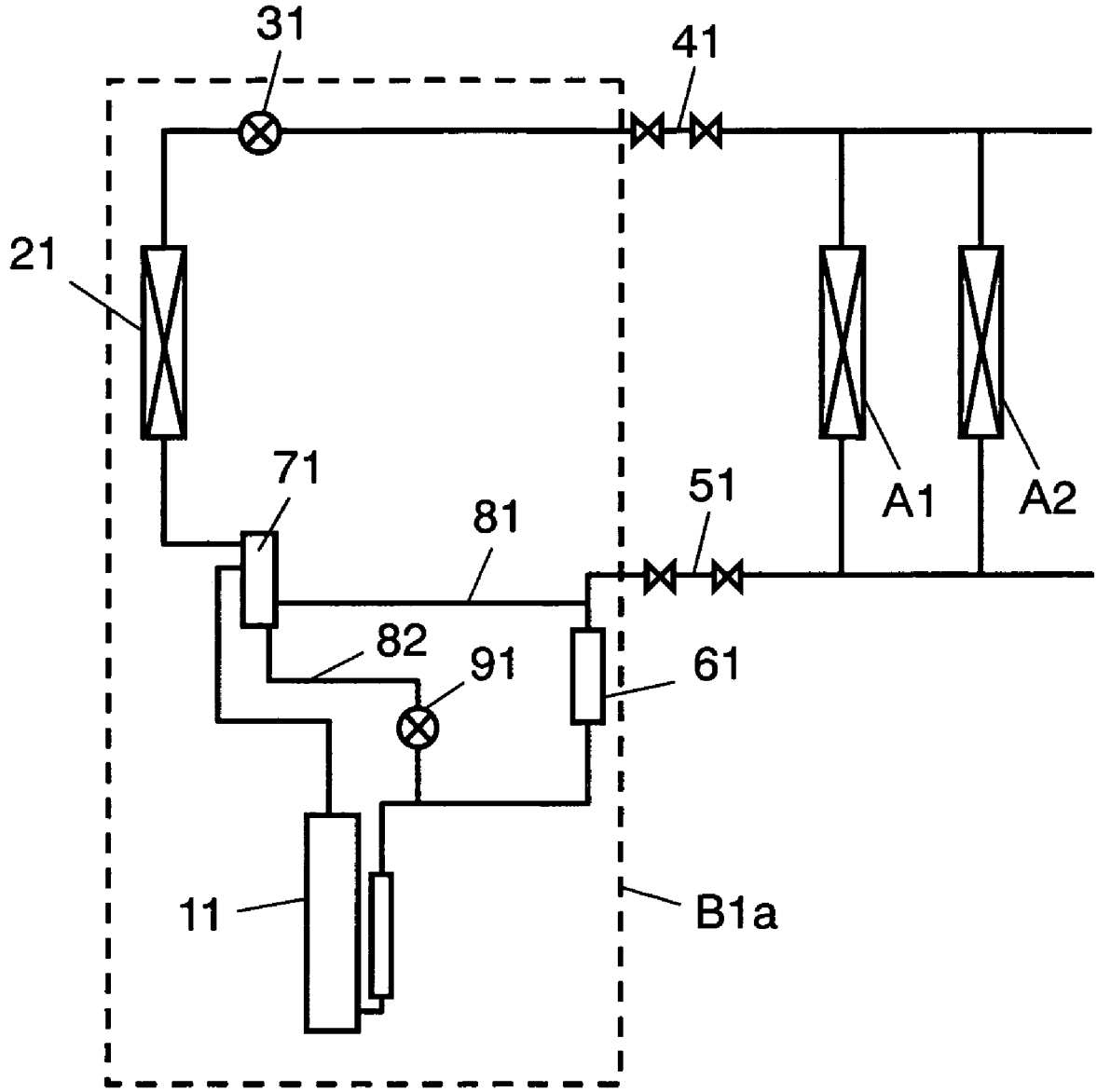
FIG. 1 is a system diagram showing an air conditioner according to a first embodiment of the present invention.

FIG. 1 is a system diagram showing an air conditioner according to a first embodiment of the present invention. As shown in FIG. 1, in the air conditioner according to the first embodiment of the present invention, indoor units A1 and A2 are connected with outdoor unit B1*a* via liquid pipe 41 and gas pipe 51. In the refrigeration cycle, accumulator 61, compressor 11, condenser 21 and throttle mechanism 31 are connected in this order by refrigerant piping, and separator-with-oil-tank 71 having a predetermined capacity is disposed between compressor 11 and condenser 21. Separator-with-oil-tank 71 has the function of storing extra oil, and also has the function of separating the oil contained in the refrigerant and returning it to compressor 11. Separator-with-oil-tank 71 has the additional function of supplying oil to compressor 11 when the amount becomes insufficient.

Separator-with-oil-tank 71 is disposed between the outlet of compressor 11 and the inlet of condenser 21, and is provided with an oil separation mechanism. Separator-with-oil-tank 71 has an oil reservoir provided with first oil return tube 81 positioned above the surface of the extra oil, and second oil return tube 82 positioned below the surface of the extra oil.

The refrigerant gas allows the oil that has been discharged into the exhaust gas to be separated from the gas and then to be dropped. In the case of providing a single indoor unit, the oil thus separated in separator-with-oil-tank 71 by this refrigerant gas is returned from first oil return tube 81 to the inlet tube of compressor 11. On the other hand, in the case where indoor units A1 and A2 are connected, replenishing the refrigerant gas would cause a decrease in the oil dilution ratio. To avoid the decrease, the extra oil thus stored is supplied to compressor 11 through opening valve 91 from second oil return tube 82. This operation can maintain the oil level of compressor 11 without the influence of the replenishment of the refrigerant gas, and can also maintain the required oil dilution ratio so as to improve the reliability.

SECOND EMBODIMENT

Figure 2:
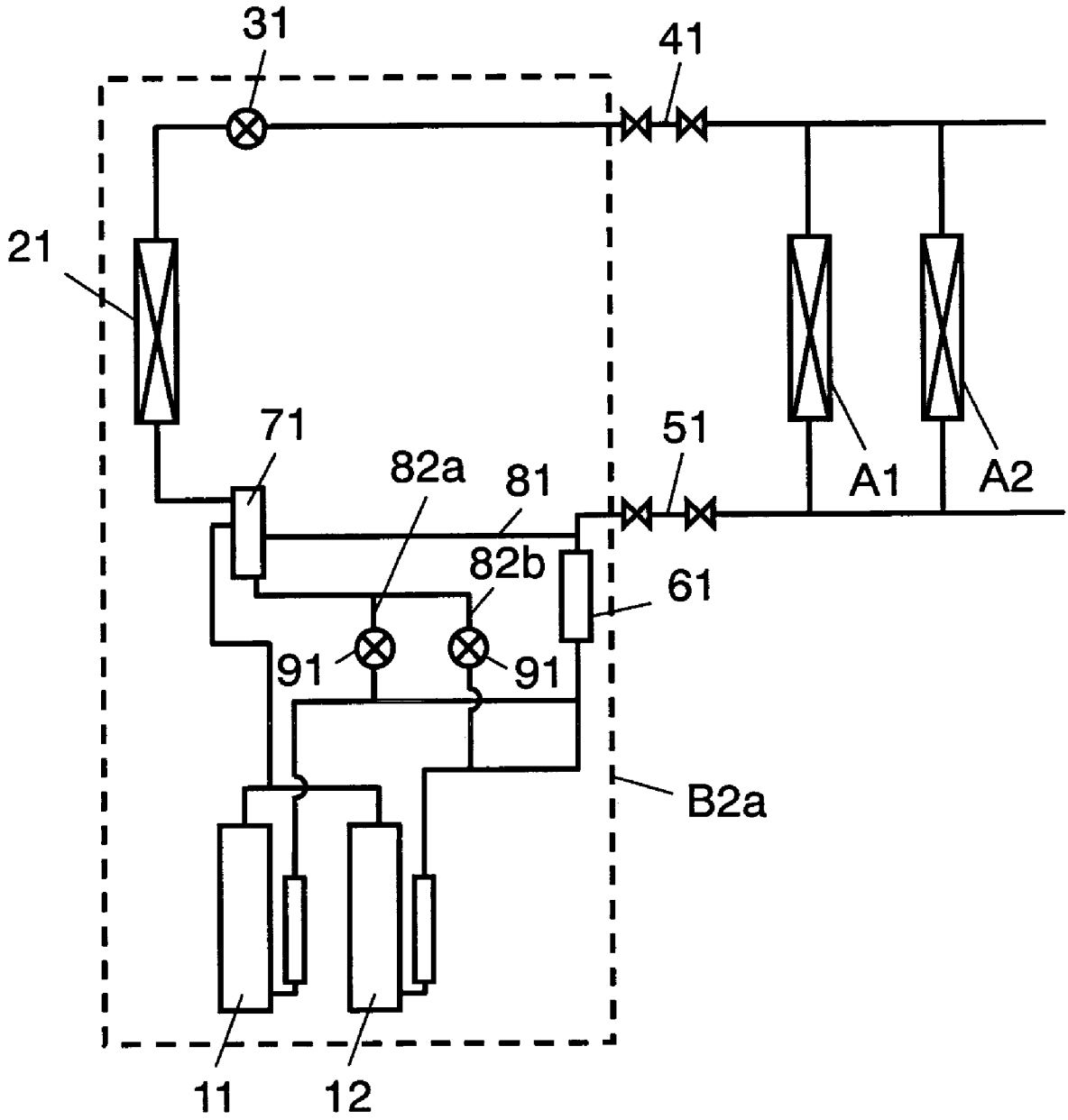
FIG. 2 is a system diagram showing an air conditioner according to a second embodiment of the present invention.

FIG. 2 is a system diagram showing an air conditioner according to a second embodiment of the present invention. As shown in FIG. 2, in the air conditioner according to the second embodiment of the present invention, indoor units A1 and A2 are connected with outdoor unit B2*a* via liquid pipe 41 and gas pipe 51. In the refrigeration cycle, accumulator 61, compressors 11 and 12, condenser 21, and throttle mechanism 31 are connected in this order by refrigerant piping, and separator-with-oil-tank 71 is disposed between compressors 11, 12 and condenser 21. Note that separator-with-oil-tank 71 has the same functions as in the first embodiment.

Separator-with-oil-tank 71 is disposed between the confluence of the outlets of compressors 11, 12 and the inlet of condenser 21, and is provided with an oil separation mechanism. Separator-with-oil-tank 71 has an oil reservoir provided with first oil return tube 81 positioned above the surface of the extra oil, and second oil return tubes 82*a* and 82*b* positioned below the surface of the extra oil.

The refrigerant gas allows the oil that has been discharged into the exhaust gas to be separated from the gas and then to be dropped. In the case of providing a single indoor unit, the oil thus separated in separator-with-oil-tank 71 by this refrigerant gas is returned from first oil return tube 81 to the inlet tubes of compressors 11 and 12. On the other hand, in the case where indoor units A1 and A2 are connected, replenishing the refrigerant gas would cause a decrease in the oil dilution ratio. To avoid the decrease, the extra oil thus stored is supplied to compressors 11 and 12 through opening valves 91 from second oil return tubes 82*a* and 82*b*. This operation can maintain the oil level of compressors 11 and 12 without the influence of the replenishment of the refrigerant gas, and can also maintain the required oil dilution ratio so as to improve the reliability.

THIRD EMBODIMENT

Figure 3:
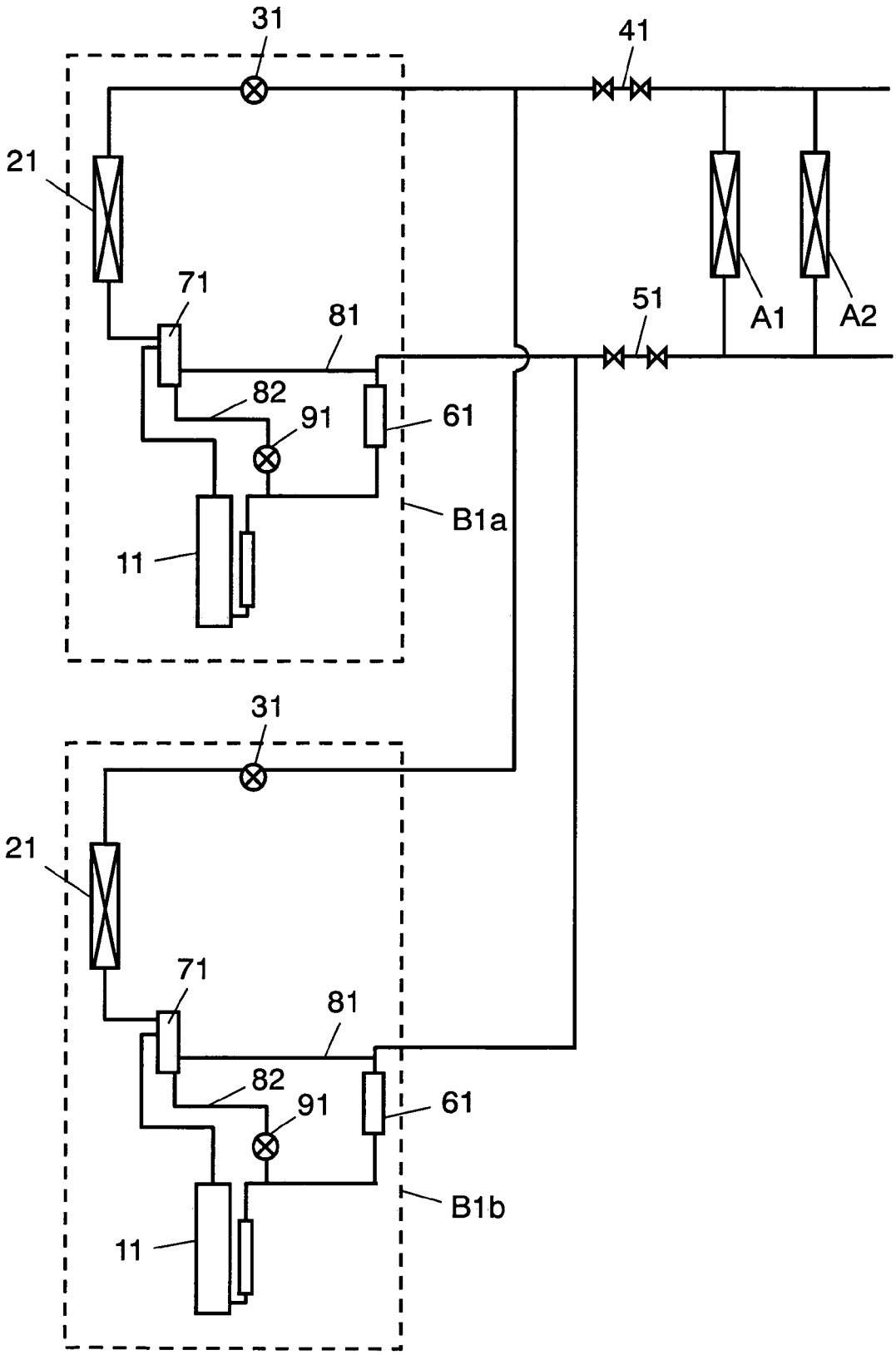
FIG. 3 is a system diagram showing an air conditioner according to a third embodiment of the present invention.

FIG. 3 is a system diagram showing an air conditioner according to a third embodiment of the present invention. As shown in FIG. 3, in the air conditioner according to the third embodiment of the present invention, indoor units A1 and A2 are connected with outdoor units B1*a* and B1*b* via liquid pipe 41 and gas pipe 51. In each refrigeration cycle of outdoor units B1*a* and B1*b*, accumulator 61, compressor 11, condenser 21, and throttle mechanism 31 are connected in this order by refrigerant piping, and separator-with-oil-tank 71 is disposed between compressor 11 and condenser 21. Note that separator-with-oil-tank 71 has the same functions as in the first embodiment.

In each refrigeration cycle, separator-with-oil-tank 71 is disposed between the outlet of compressor 11 and the inlet of condenser 21, and is provided with an oil separation mechanism. Separator-with-oil-tank 71 has an oil reservoir provided with first oil return tube 81 positioned above the surface of the extra oil, and second oil return tube 82 positioned below the surface of the extra oil.

The connection between indoor units A1 and A2 and the connection between outdoor units B1*a* and B1*b* require longer piping. Replenishing the refrigerant gas would cause a decrease in the oil dilution ratio. To avoid the decrease, the extra oil thus stored is supplied to compressor 11 of outdoor unit B1*a* through opening valve 91 from second oil return tube 82 of separator-with-oil-tank 71 of outdoor unit B1*a*. This operation can maintain the oil level of compressor 11 in outdoor unit B1*a* without the influence of the replenishment of the refrigerant gas, and can also maintain the required oil dilution ratio so as to improve the reliability.

In the case where a decrease in the oil dilution ratio cannot be avoided only by supplying the extra oil of separator-with-oil-tank 71 of outdoor unit B1*a*, the extra oil is supplied to compressor 11 of outdoor unit B1*b* through opening valve 91 from second oil return tube 82 of separator-with-oil-tank 71 in outdoor unit B1*b*. This operation can prevent a decrease in the oil dilution ratio, and also can maintain the oil level of compressor 11 in outdoor unit B1*b* so as to improve the reliability.

FOURTH EMBODIMENT

Figure 4:
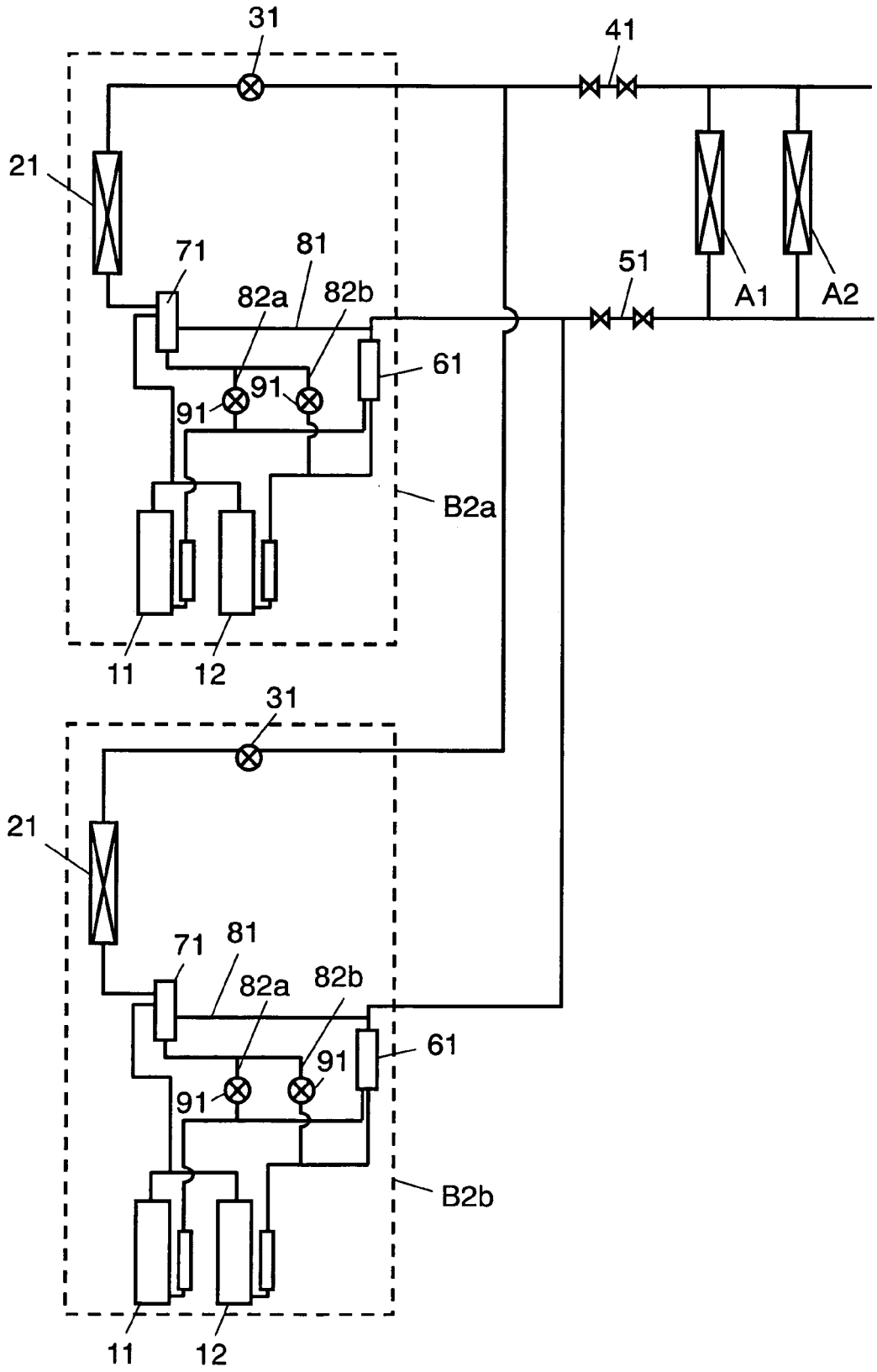
FIG. 4 is a system diagram showing an air conditioner according to a fourth embodiment of the present invention.
Figure 5:
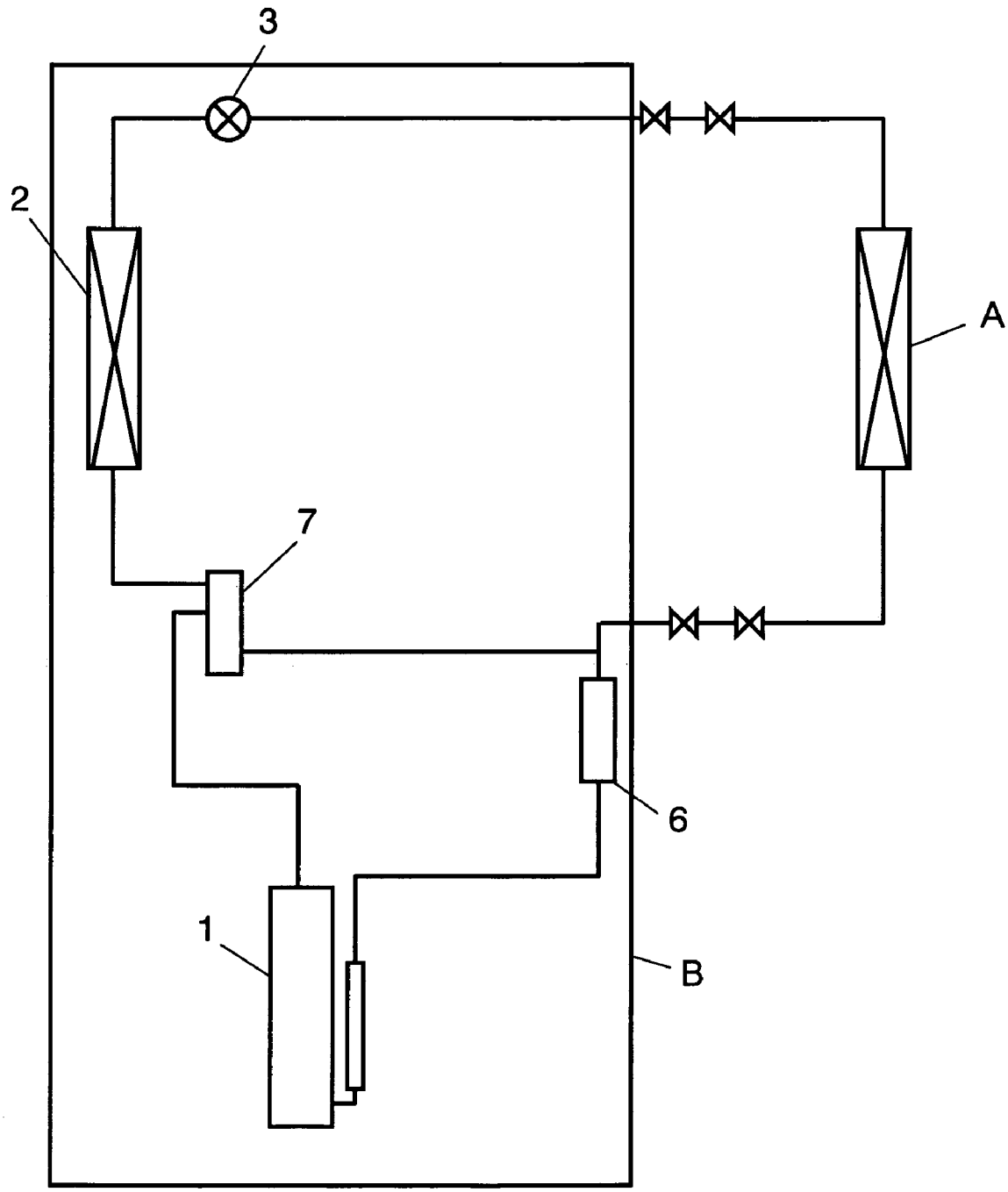
FIG. 5 (PRIOR ART)
FIG. 5 is a system diagram showing a conventional air conditioner.

FIG. 4 is a system diagram showing an air conditioner according to a fourth embodiment of the present invention. As shown in FIG. 4, in the air conditioner according to the fourth embodiment of the present invention, indoor units A1 and A2 are connected with outdoor units B2*a* and B2*b* via liquid pipe 41 and gas pipe 51. In each refrigeration cycle of outdoor units B2*a* and B2*b*, accumulator 61, compressors 11 and 12, condenser 21, and throttle mechanism 31 are connected in this order by refrigerant piping, and separator-with-oil-tank 71 is disposed between compressors 11, 12 and condenser 21. Note that separator-with-oil-tank 71 has the same functions as in the first embodiment.

In each refrigeration cycle, separator-with-oil-tank 71 is disposed between the confluence of the outlets of compressors 11, 12 and the inlet of condenser 21, and is provided with an oil separation mechanism. Separator-with-oil-tank 71 has an oil reservoir provided with first oil return tube 81 positioned above the surface of the extra oil, and second oil return tubes 82*a* and 82*b* positioned below the surface of the extra oil.

The connection between indoor units A1 and A2 and the connection between outdoor units B2*a* and B2*b* require longer piping. Replenishing the refrigerant gas would cause a decrease in the oil dilution ratio. To avoid the decrease, the extra oil thus stored is supplied to compressor 11 of outdoor unit B2*a* through opening valve 91 from second oil return tubes 82*a* and 82*b* of separator-with-oil-tank 71 of outdoor unit B2*a*. This operation can maintain the oil level of compressors 11 and 12 in outdoor unit B2*a* without the influence of the replenishment of the refrigerant gas, and can also maintain the required oil dilution ratio so as to improve the reliability.

In the case where a decrease in the oil dilution ratio cannot be avoided only by supplying the extra oil of separator-with-oil-tank 71 of outdoor unit B2*a*, extra oil is also supplied to compressors 11 and 12 of outdoor unit B2*b* through opening valve 91 from second oil return tubes 82*a* and 82*b* of separator-with-oil-tank 71 of outdoor unit B2*b*. This operation can prevent a decrease in the oil dilution ratio, and can also maintain the oil level of compressors 11 and 12 in outdoor unit B2*b* so as to improve the reliability.

Although one or two compressors are provided in the aforementioned embodiments, three or more compressors may be provided. These compressors may have different abilities from each other.

The aforementioned embodiments are on the condition of using refrigerant R22 currently used for air conditioners, and oil that can be dissolved in it. However, instead of these, HFC mixture refrigerants and oil that can be dissolved in them can be used.

As described hereinbefore, in the air conditioner according to the present invention, separator with an oil tank is disposed between the outlet of the compressor and the inlet of the condenser. As a result, even when the refrigerant gas is replenished to cope with a change in the type or number of the indoor units or a change in the number of the outdoor units, it becomes possible to securely return the oil to the highly versatile general compressor in the refrigeration cycle while maintaining the required oil dilution ratio.

What is claimed is:

1. An air conditioner comprising:

an indoor unit having an evaporator;

an outdoor unit having a compressor, a condenser and a throttle mechanism, the outdoor unit being connected with the indoor unit via piping; and a separator with an oil tank which is disposed between the compressor and the condenser, wherein the separator with the oil tank comprises:

an oil reservoir for storing extra oil;

a first oil return tube positioned above the oil reservoir; and a second oil return tube positioned below the oil reservoir, wherein the outdoor unit includes a plurality of highly versatile general compressors; and the compressor has a suction tube to be connected with the second oil return tube positioned below the oil reservoir.

* * * * *